US008277075B2

(12) United States Patent
Lin et al.

(10) Patent No.: US 8,277,075 B2
(45) Date of Patent: Oct. 2, 2012

(54) ILLUMINATION DEVICE USING SOLAR ENERGY

(76) Inventors: Binjih Lin, Fremont, CA (US); Alan Yun-Chen Tsai, Taichung (TW); Yuan Tseh Lin, Taichung (TW); Hsiue-Cheng Lin, Taichung (TW)

( * ) Notice: Subject to any disclaimer, the term of this patent is extended or adjusted under 35 U.S.C. 154(b) by 223 days.

(21) Appl. No.: 12/901,570

(22) Filed: Oct. 10, 2010

(65) Prior Publication Data

US 2012/0087114 A1 Apr. 12, 2012

(51) Int. Cl.
*F21V 33/00* (2006.01)

(52) U.S. Cl. ..... 362/192; 362/183

(58) Field of Classification Search ..... 362/192, 362/183

See application file for complete search history.

(56) References Cited

U.S. PATENT DOCUMENTS

| | | | | |
|---|---|---|---|---|
| 4,355,628 | A * | 10/1982 | Watts | 126/609 |
| 5,540,216 | A * | 7/1996 | Rasmusson | 126/683 |
| 7,975,685 | B2 * | 7/2011 | Zhao | 126/683 |
| 2007/0070628 | A1 * | 3/2007 | Chen | 362/249 |

* cited by examiner

*Primary Examiner* — Laura Tso

(57) ABSTRACT

An illumination device includes a reflection disk, a positioning frame, a solar cell module, an illumination member and a driving device. The positioning frame is located at the focus of the curved reflection surface of the reflection disk. The solar cell module and the illumination member are respectively connected to the front and back of the positioning frame. The driving device is used to drive the positioning frame to rotate relative to the reflection disk. When the solar cell faces the curved reflection surface, the solar cell absorbs the reflected sun light to generate electric power. When the illumination member faces the curved reflection surface, light emitted from the illumination member is reflected by the curved reflection surface.

13 Claims, 11 Drawing Sheets

ILLUMINATION DEVICE USING SOLAR ENERGY

FIELD OF THE INVENTION

The present invention relates to an illumination device, and more particularly, to an illumination device using solar energy.

BACKGROUND OF THE INVENTION

The solar energy is very important substitute energy and many of generating devices using solar energy are successfully developed and applied to different types of industries. From the approximately past several ten years ago, great attention has been paid to silicon solar cells (photoelectric conversion element) as a power source which is harmless to the environment. A solar cell basically includes a substrate provided a lower electrode thereon, a conductive film, a light-absorption layer, a window layer provided an upper electrode thereon, and a buffer layer formed between the light-absorption layer and the window layer. Photovoltaic cells for producing electricity from sunlight have been disclosed by U.S. Pat. No. 2,530,408, U.S. Pat. No. 5,350,644 and U.S. Pat. No. 7,737,356, and reference: Y Uchida et al., "Conversion Efficiency of Large Area a-Si:H Solar Cell", Conference Proceedings, Fifteenth IEEE Photovoltaic Specialist Conference, Florida (1981), pp. 922-927.

As well known, conventional solar cells are such as crystalline silicon solar cell (referring to U.S. Pat. No. 7,666,706 and U.S. Pat. No. 7,029,644), polysilicon solar cell employing polycrystalline silicon (single crystal silicon), amorphous silicon solar cell (referring to U.S. Pat. No. 6,307,146, U.S. Pat. No. 5,693,745 and U.S. Pat. No. 5,334,259, and reference: C. R. Wronski, "The Dependence of Solar Cell Characteristics on the _Electronic Properties of Discharge Produced, Hydrogenated Amorphous _Silicon", Conf. Record, 13th IEEE Photovoltaic Specialists Conf., _June 1978, pp. 744-750.), copper indium selenide solar cell, and compound semiconductor solar cell. These solar cells have already been practically used in industrial and household applications. Some of these solar cells employing silicon require high manufacturing cost. Recently, thin-film crystalline silicon solar cell, compound semiconductor solar cell, and amorphous silicon solar cell are studied and developed extensively as they can be formed by low cost.

The present invention intends to provide an application of the solar cell module which is used for illumination. The application can be used for the street lights, garden lights or wall lights. The conventional illumination devices generally comprise a reflection disk, solar cells and illumination members. Nevertheless, all of the components are installed separately, the illumination members cannot be rotated with the solar cells so that they cannot be located at the focus of the reflection disk. In other words, at least one of the two components is not located at the focus of the reflection disk so that the efficiency will be low and the illumination members cannot provide sufficient illumination features.

SUMMARY OF THE INVENTION

The primary object of the present invention is to provide an illumination device using the solar energy so as to have higher efficiency. To achieve the object, the present invention relates to an illumination device includes a reflection disk with a curved reflection surface, a positioning frame located at the focus of the curved reflection surface, a solar cell module whose solar cell located on a front surface of the positioning frame, an illumination member located on a back of the positioning frame, and a driving device for driving the positioning frame to rotate relative to the reflection disk. When the solar cell faces the curved reflection surface, the solar cell absorbs the reflected sun light to generate electric power. When the illumination member faces the curved reflection surface, light emitted from the illumination member is reflected by the curved reflection surface.

The second object of the present invention is to provide an illumination device using the solar energy wherein the device is moved with the movement of the sun at daily basis. To achieve the object, the present invention provides a second truss to which the reflection disk is pivotably connected. A second driving device is used to drive the reflection disk to rotate relative to the second truss.

The third object of the present invention is to provide an illumination device using the solar energy wherein the device is moved with the movement of the sun at seasonal basis. To achieve the object, the present invention provides a second truss wherein the second truss is connected to a base by at least one inclination adjustment device which adjusts inclination angle of the second truss relative to the base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2A:
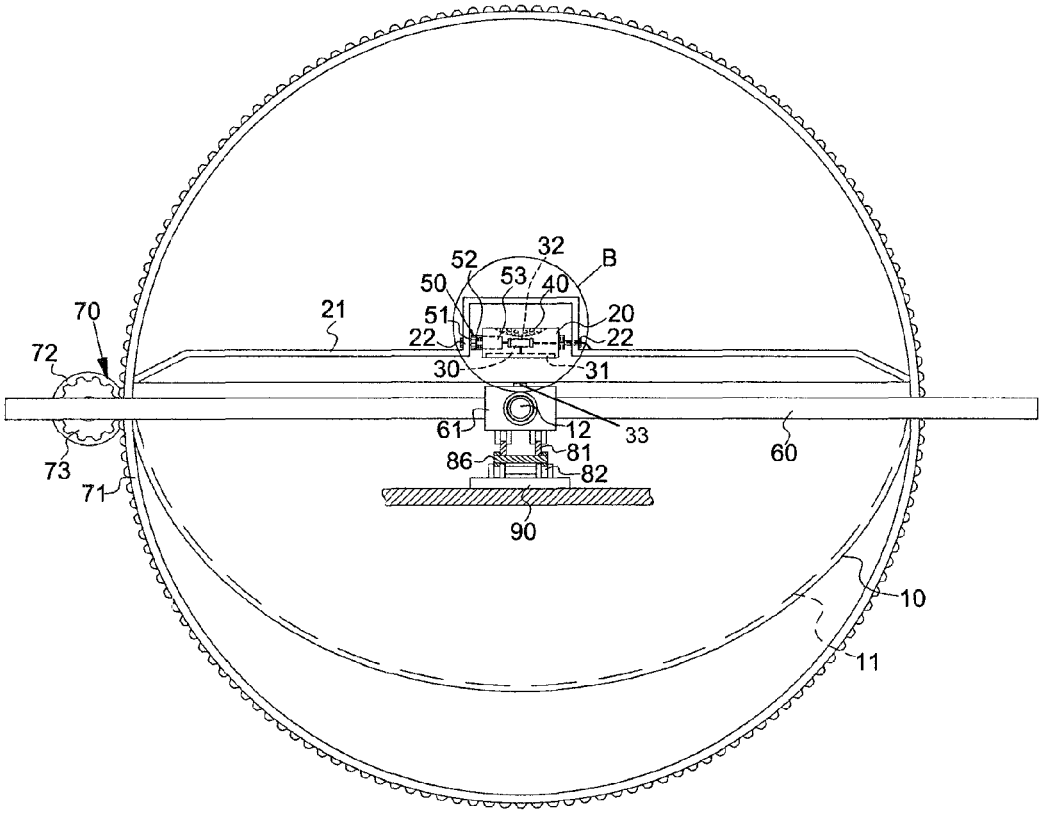
FIG. 2A is an enlarged cross-sectional view taken along line A-A of FIG. 1.
Figure 2B:
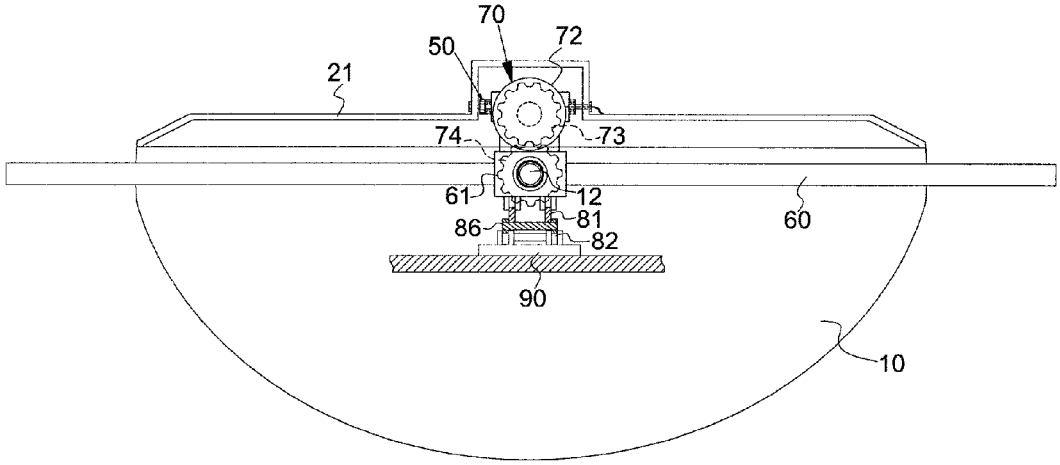
FIG. 2B is an enlarged view of the circle B of FIG. 2A.
Figure 3:
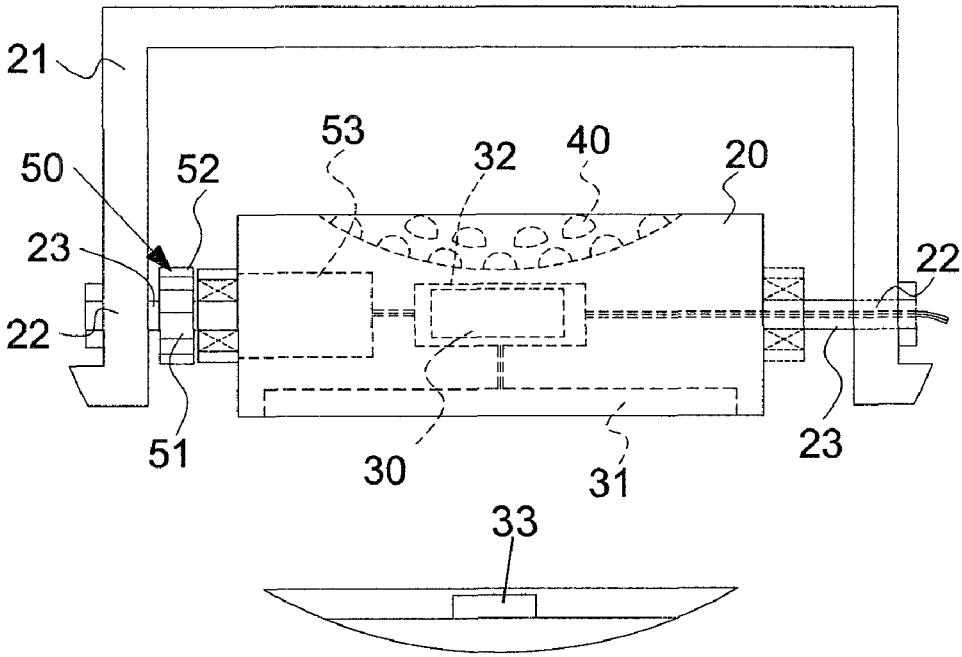
FIG. 3 shows another embodiment of the second driving device in accordance with the present invention.
Figure 4:
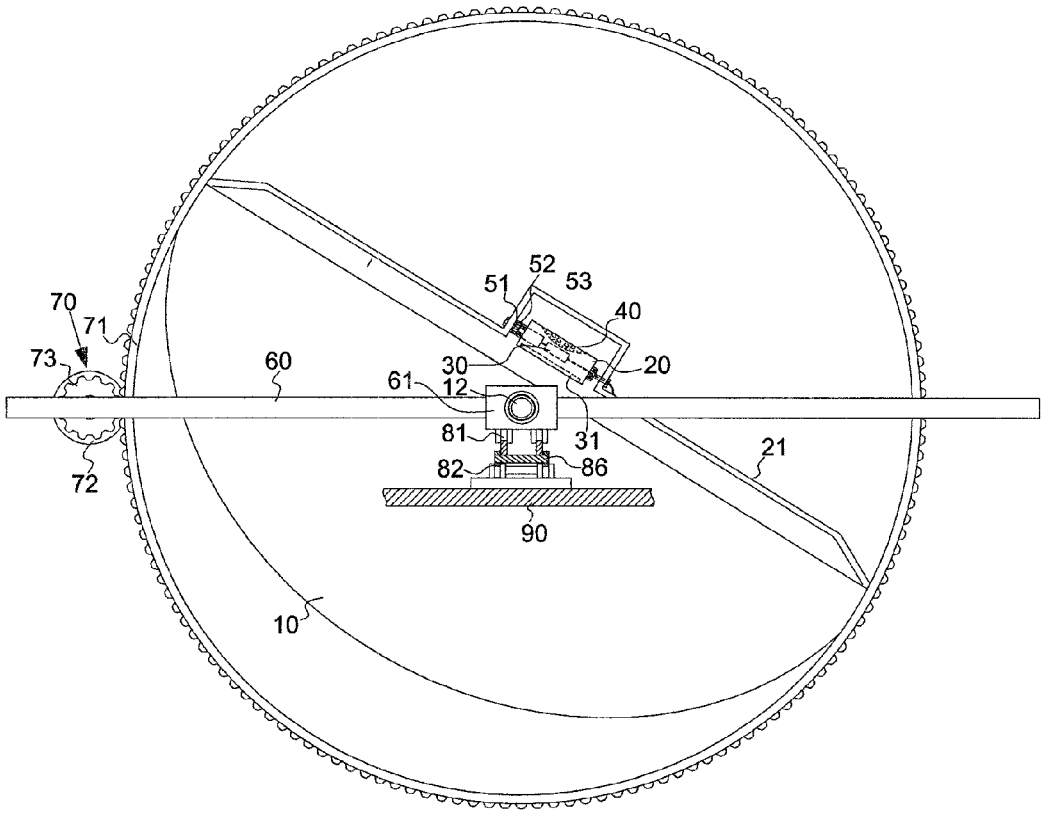
FIG. 4 shows that the opening of the reflection disk faces right-up direction in accordance with the present invention.
Figure 5:
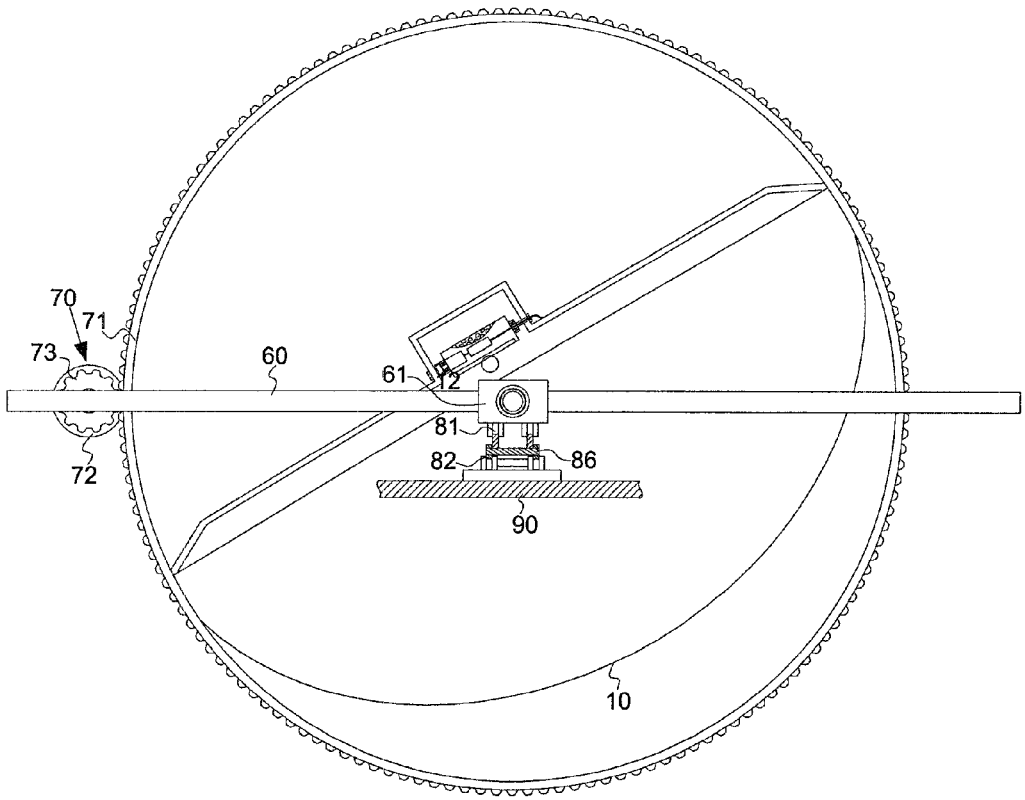
FIG. 5 shows that the opening of the reflection disk faces left-up direction in accordance with the present invention.
Figure 6:
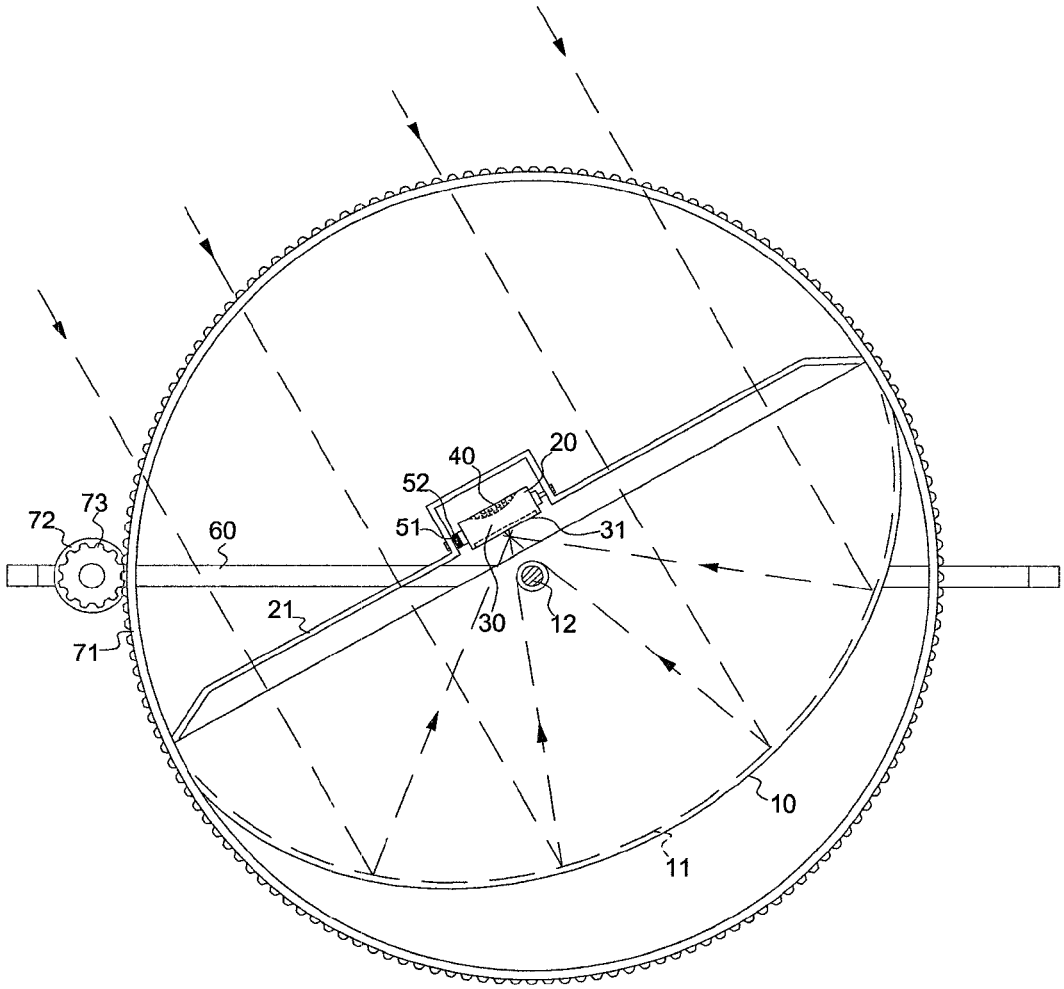
FIG. 6 shows that the opening of the reflection disk faces left-up direction so as to collect the sun light to the solar cells in accordance with the present invention.
Figure 7:
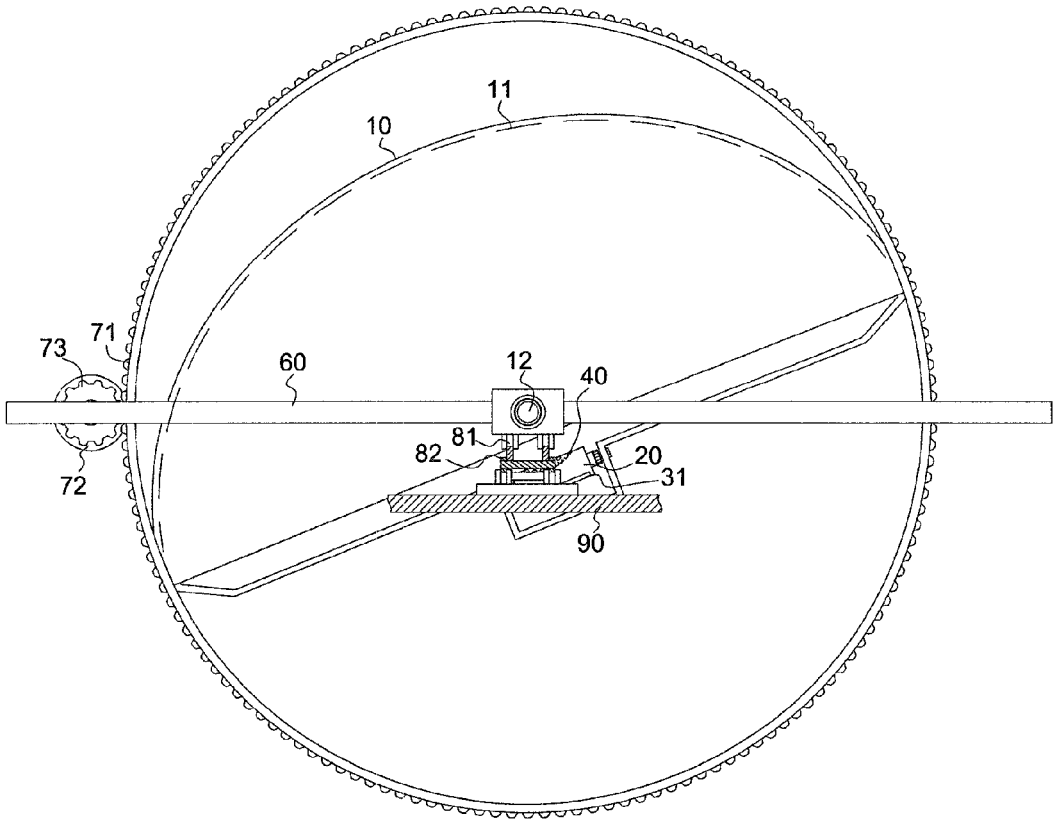
FIG. 7 shows that the opening of the reflection disk faces right-down direction in accordance with the present invention.
Figure 8:
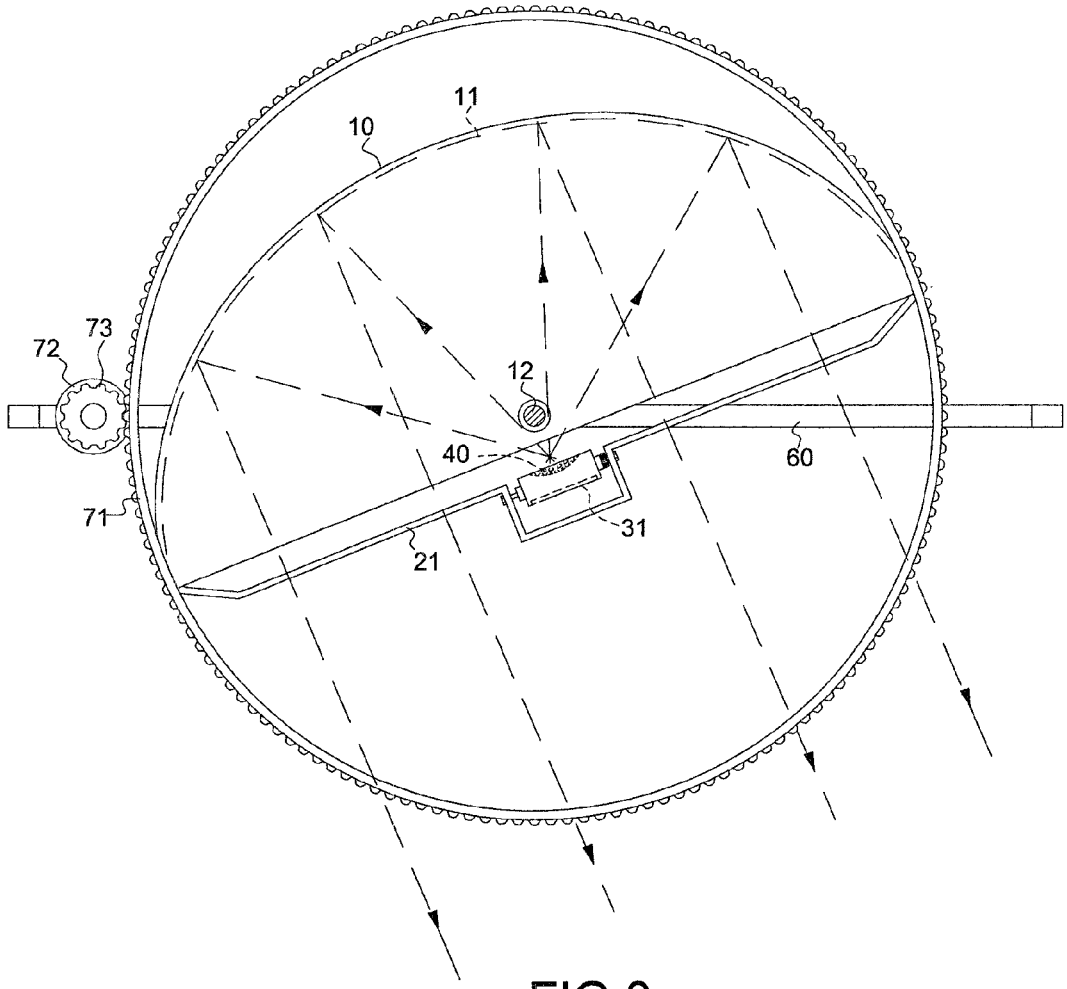
FIG. 8 shows that the opening of the reflection disk faces right-down direction so as to reflect the light of the illumination member in accordance with the present invention.

Referring to FIGS. 1 to 10, the illumination device using solar energy of the present invention comprises a reflection disk 10 having a curved reflection surface 11 which reflects light beams to a focus of the curved reflection surface 11. A positioning frame 20 is located at the focus of the curved reflection surface 11 by a first truss 21. A solar cell module 30 has a solar cell 31 which is located on the front surface of the positioning frame 20. At least one illumination member 40 is located on the back of the positioning frame 20 and powered by the solar cell module 30. A first driving device 50 drives the positioning frame 20 to rotate relative to the reflection disk 10. As shown in FIGS. 4-6, when the solar cell 31 faces the curved reflection surface 11, the solar cell 31 absorbs reflected sun light so as to generate electric power. As shown in FIGS. 7 and 8, when the at least one illumination member 40 faces the curved reflection surface 11, light emitted from the at least one illumination member 40 is reflected by the curved reflection surface 11 so as to provide illumination. A second truss 60 and the reflection disk 10 are pivotably connected to the second truss 60. A second driving device 70 drives the reflection disk 10 to rotate relative to the second truss 60. As shown in FIGS. 4 to 6, the opening of the reflection disk 10 faces right-up direction relative to the second truss 60. As shown in FIGS. 7 and 8, the opening of the reflection disk 10 faces downward direction relative to the second truss 60.

Figure 1:
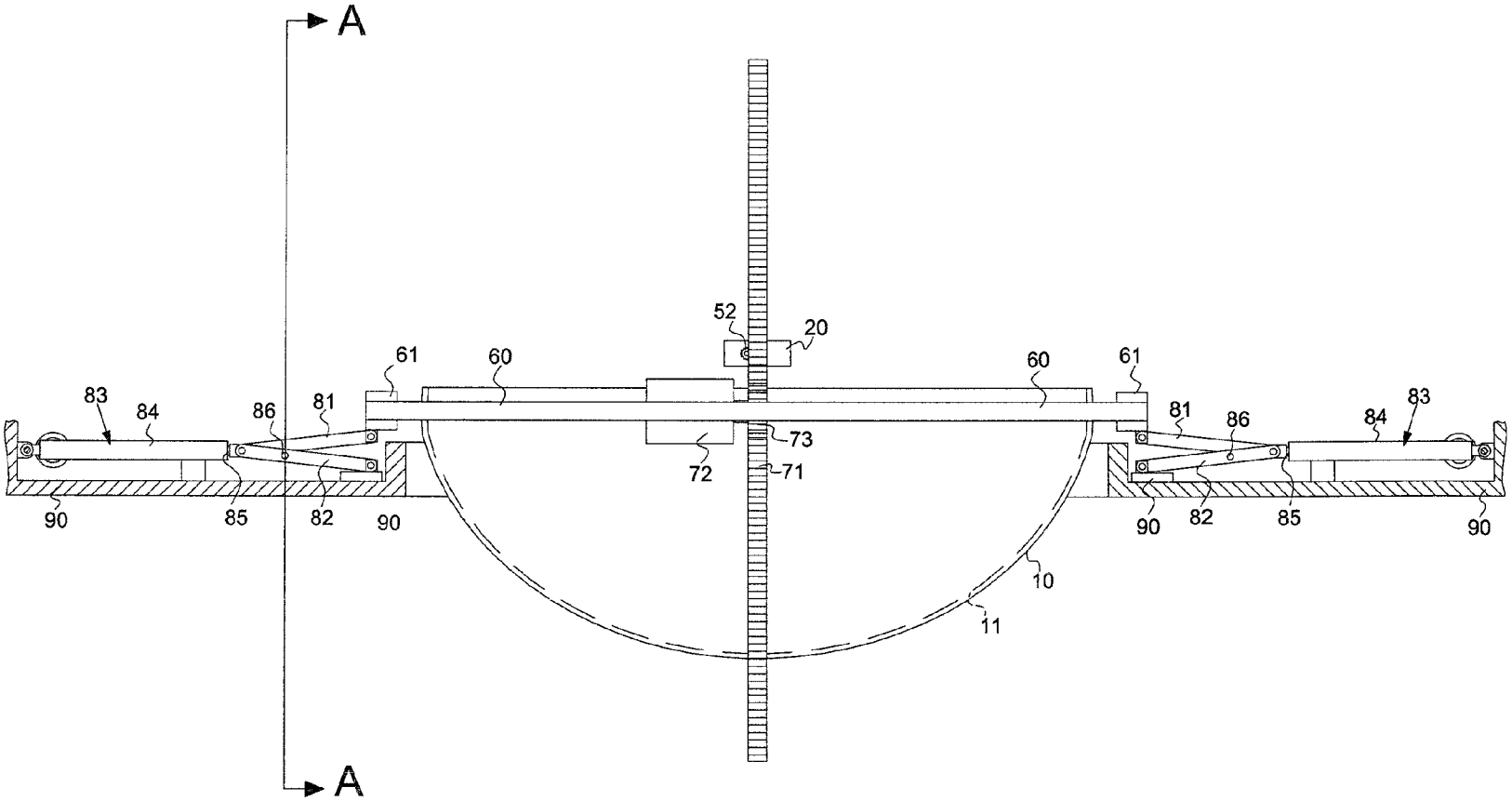
FIG. 1 is a front plan view of the illumination device in accordance with the present invention.

Referring to FIGS. 1-3, in one preferable embodiment, the illumination device further comprises a control module 32. The control module 32 can respectively control the first driving device 50 to drive the positioning frame 20 and the second driving device 70 to drive the reflection disk 10 automatically in a predetermined mode. In this embodiment, it is preferable to have an illumination sensor 33 connected with the control module 32. When the sensor 33 detects the illumination of outside is lower than a predetermined value, the control module 32 controls the second driving device 70 to drive the reflection disk 10 to rotate relative to the second truss 60, so that the opening of the reflection disk 10 faces downward direction, and controls the first driving device 50 to drive the positioning frame 20 to rotate relative to the reflection disk 10, so that the illumination member 40 faces the curved reflection surface 11 to emit light reflected by the curved reflection surface 11 for lighting. In one further preferable embodiment, the predetermined mode of the control module can be reset its initial and end time of control action according to the season and the position of the user on the earth.

As shown in FIG. 1, preferably, the at least one illumination member 40 includes multiple illumination members 40 which are light emitting diodes so as to provide sufficient illumination and save energy.

As shown in FIGS. 1-3, the first truss 21 has two first pivotal frames 22 and the positioning frame 20 has two first pivots 23 which are pivotably connected to the first pivotal frame 22. The first driving device 50 includes a first gear 51, a second gear 52 and a first motor 53. The first gear 51 is fixed to the first pivotal frame 22, and the first motor 53 is fixed to the positioning frame 20 and powered by the solar cell module 30. The second gear 52 is engaged with the first gear 51 and driven by the first motor 53.

The second truss 60 has two second pivotal frames 61 and the reflection disk 10 includes two second pivots 12 which are pivotably connected to the second pivotal frames 61. Referring to FIG. 2A, one embodiment of the second driving device 70 includes a curved rack 71 fixed to outside of the reflection disk 10. In this embodiment, the curved rack 71 is a circular rack. The curved rack 71 is pivotable about the second pivot 12. A second electric motor 72 is fixed to the second truss 60. A third gear 73 is engaged with the curved rack 71 and powered by the second electric motor 72. Referring to FIG. 2B, another embodiment of the second driving device 70 includes a forth gear 74 coaxially fixed with the second pivot 12, a second electric motor 72 is fixed to the second truss 60, a third gear 73 is engaged with the forth gear 74 and powered by the second electric motor 72. In these embodiments, the second electric motor 72 is powered by the solar cell module 30.

Figure 9:
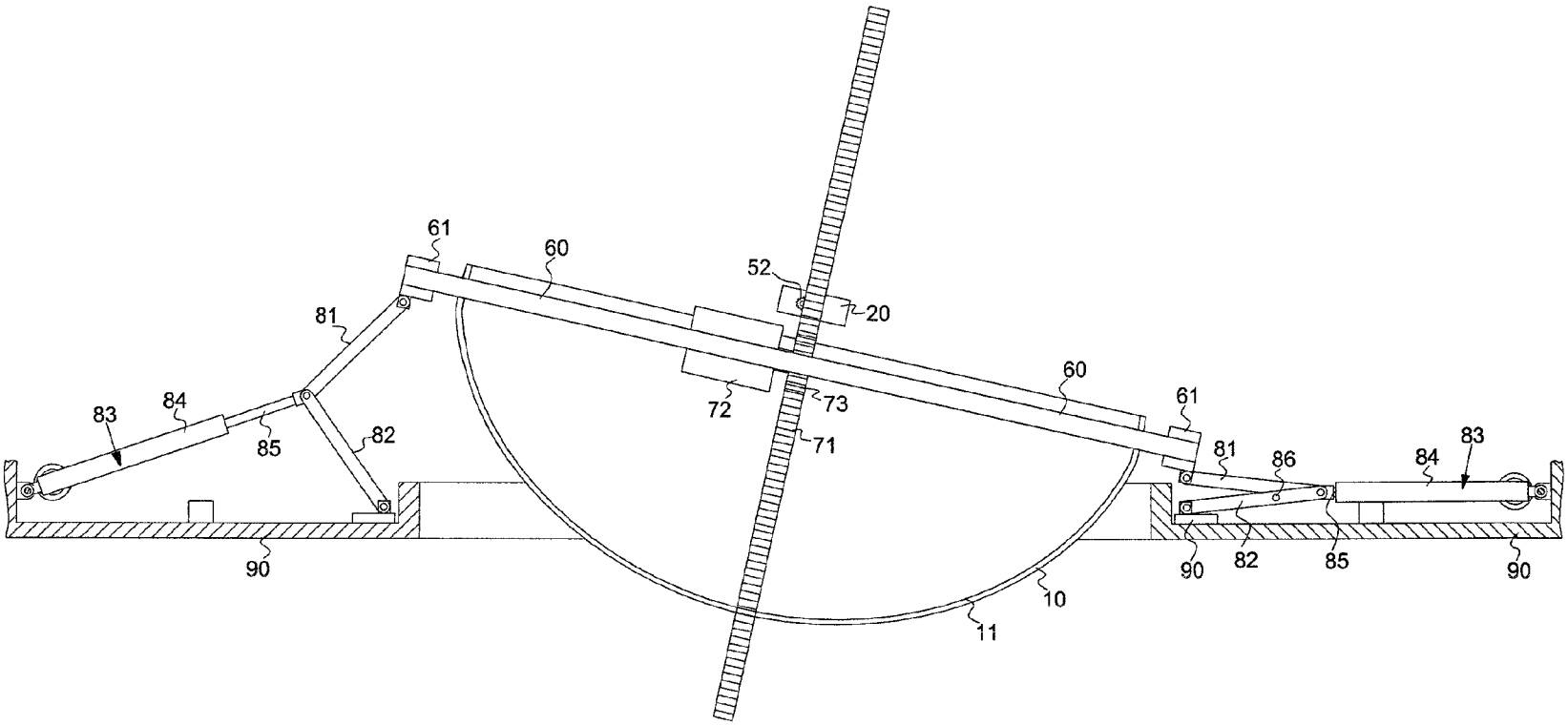
FIG. 9 shows that the second truss and the reflection disk are adjusted toward right by using the inclination adjustment device in accordance with the present invention.
Figure 10:
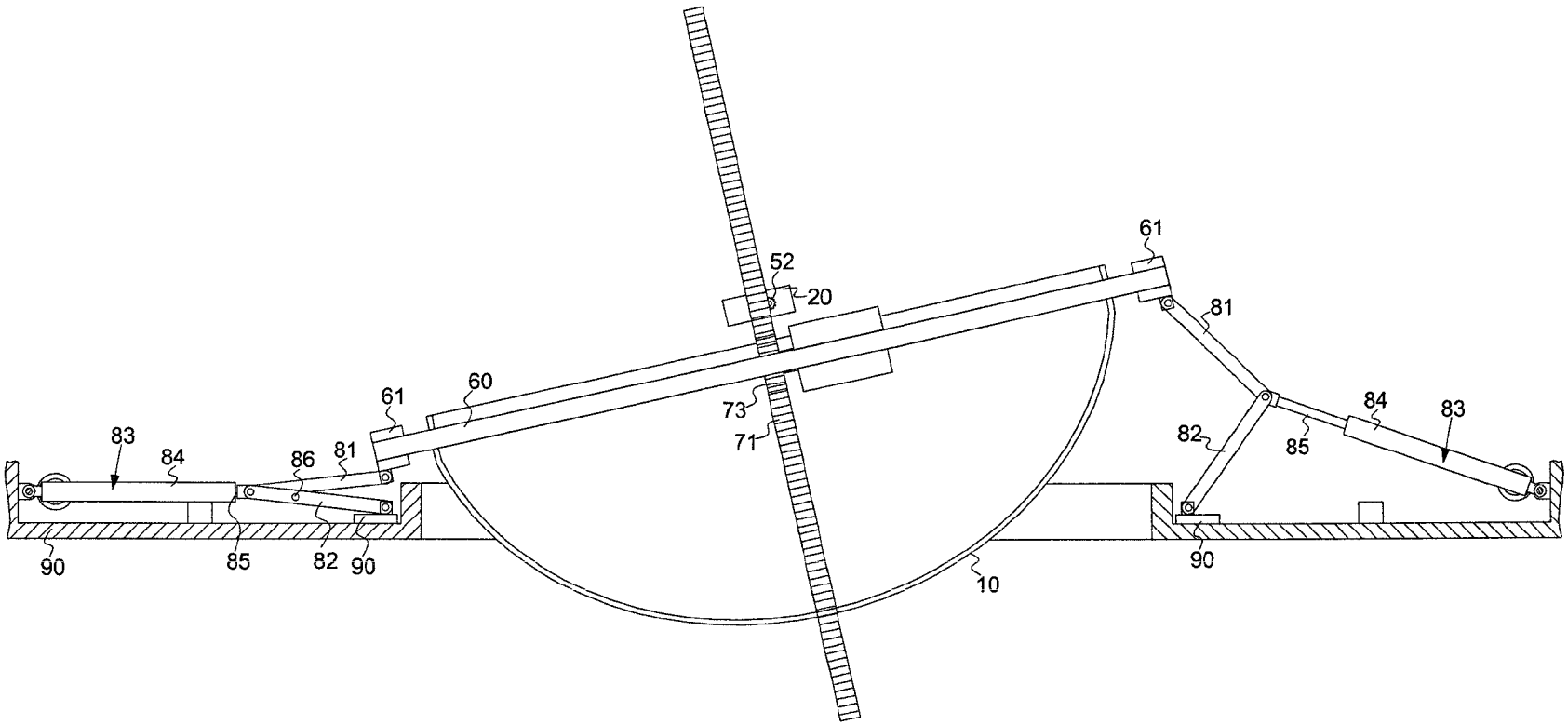
FIG. 10 shows that the second truss and the reflection disk are adjusted toward left by using the inclination adjustment device in accordance with the present invention.

As shown in FIGS. 3, 9 and 10, the second truss 60 is connected to a base 90 by at least one inclination adjustment device 80 which adjusts inclination angle of the second truss 60 relative to the base 90. By this way, the reflection disk 10 can track the movement of the sun to increase the efficiency of collecting the sun light.

FIGS. 3, 9 and 10 show that the at least one inclination adjustment device 80 includes two inclination adjustment devices 80 which are respectively connected between two sides of the second truss 60 and the base 90. In one embodiment of the present invention, each inclination adjustment device 80 is a toggle mechanism having the function of enlargement of input force (many application of toggle mechanism can be referred to U.S. Pat. No. 4,159,634, U.S. Pat. No. 6,053,724 and U.S. Pat. No. 5,871,202), which includes a first link 81 which has a first end pivotably connected to the second truss 60. A second link 82 has a first end pivotably connected to a second end of the first link 81. A second end of the second link 82 is pivotably connected to the base 90. An electric activation device 83 has a body 84 and a retractable rod 85. The body 84 is pivotably connected to the base 90 and the retractable rod 85 is pivotably connected to a joint between the first and second links 81, 82. When the electric activation device 83 is activated, the retractable rod 85 is moved relative to the body 84 and drives the first and second links 81, 82. In this embodiment, the second link 82 has a transverse bar 86 connected thereto. When the first link 81 moves toward the second link 82, the transverse bar 86 supports the first link 81 and stops a movement of the first link 81.

While we have shown and described the embodiment in accordance with the present invention, it should be clear to those skilled in the art that further embodiments may be made without departing from the scope of the present invention.

What is claimed is:

1. An illumination device comprising:

a reflection disk having a curved reflection surface which reflects light beams to a focus of the curved reflection surface;

a positioning frame being located at the focus of the curved reflection surface by a first truss;

a solar cell module having a solar cell which is located on a front surface of the positioning frame;

at least one illumination member located on a back of the positioning frame and powered by the solar cell module;

a first driving device driving the positioning frame to rotate relative to the reflection disk, when the solar cell faces the curved reflection surface, the solar cell absorbs reflected sun light so as to generate electric power, when the at least one illumination member faces the curved reflection surface, light emitted from the at least one illumination member is reflected by the curved reflection surface;

a second truss and the reflection disk pivotably connected to the second truss, and a second driving device driving the reflection disk to rotate relative to the second truss.

2. The device as claimed in claim 1, wherein the at least one illumination member includes multiple illumination members which are light emitting diodes.

3. The device as claimed in claim 1, wherein the first truss has two first pivotal frames and the positioning frame has two first pivots which are pivotably connected to the first pivotal frame, the first driving device includes a first gear, a second gear and a first motor, the first gear is fixed to the first pivotal frame, and the first motor is fixed to the positioning frame and powered by the solar cell module, the second gear is engaged with the first gear and driven by the first motor.

4. The device as claimed in claim 1, wherein the second truss has two second pivotal frames and the reflection disk includes two second pivots which are pivotably connected to the second pivotal frames, the second driving device includes a curved rack fixed to outside of the reflection disk, the curved rack is pivotable about the second pivot, a second motor is fixed to the second truss, a third gear is engaged with the curved rack and powered by the second motor.

5. The device as claimed in claim 4, wherein the second motor is powered by the solar cell module.

6. The device as claimed in claim 1, wherein the second truss has two second pivotal frames and the reflection disk includes two second pivots which are pivotably connected to the second pivotal frames, the second driving device includes a forth gear coaxially fixed with the second pivot, a second electric motor is fixed to the second truss, a third gear is engaged with the forth gear and powered by the second electric motor.

7. The device as claimed in claim 6, wherein the second motor is powered by the solar cell module.

8. The device as claimed in claim 1, wherein the second truss is connected to a base by at least one inclination adjustment device which adjusts inclination angle of the second truss relative to the base.

9. The device as claimed in claim 8, wherein the at least one inclination adjustment device includes two inclination adjustment devices which are respectively connected between two sides of the second truss and the base, each inclination adjustment device includes a first link which has a first end pivotably connected to the second truss, a second link has a first end pivotably connected to a second end of the first link, a second end of the second link is pivotably connected to the base, an electric activation device has a body and a retractable rod, the body is pivotably connected to the base and the retractable rod is pivotably connected to a joint between the first and second links, when the electric activation device is activated, the retractable rod is moved relative to the body and drives the first and second links.

10. The device as claimed in claim 9, wherein the second link has a transverse bar connected thereto, when the first link moves toward the second link, the transverse bar supports the first link and stops a movement of the first link.

11. The device as claimed in claim 1, wherein the illumination device further comprises a control module, the control module respectively control the first driving device to drive the positioning frame and the second driving device to drive the reflection disk automatically in a predetermined mode.

12. The device as claimed in claim 11, wherein the control module connects an illumination sensor, when the sensor detects the illumination of outside is lower than a predetermined value, the control module controls the second driving device to drive the reflection disk to rotate so that the opening of the reflection disk faces downward direction, and controls the first driving device to drive the positioning frame to rotate relative to the reflection disk, so that the illumination member faces the curved reflection surface and emits light reflected by the curved reflection surface for lighting.

13. The device as claimed in claim 11, wherein the predetermined mode of the control module can be reset the initial and end time of the control.

* * * * *